United States Patent [19]

Collier

[11] Patent Number: 4,475,656

[45] Date of Patent: Oct. 9, 1984

[54] DISHWASHER TRAY

[75] Inventor: John D. Collier, Cambridge, Canada

[73] Assignee: Greening Donald Co. Ltd., Hamilton, Canada

[21] Appl. No.: 240,900

[22] Filed: Mar. 5, 1981

[30] Foreign Application Priority Data

Mar. 6, 1980 [CA] Canada ..... 347191

[51] Int. Cl.[3] ..... A47G 19/08

[52] U.S. Cl. ..... 211/41; 211/181; 211/106

[58] Field of Search ..... 211/41, 106, 181, 74

[56] References Cited

U.S. PATENT DOCUMENTS

| | | | |
|---|---|---|---|
| 1,041,751 | 10/1912 | DeLong | 211/181 X |
| 2,697,525 | 12/1954 | Breneman | 211/41 |
| 2,708,037 | 5/1955 | Planeta | 211/41 X |
| 3,032,203 | 5/1962 | Romero | 211/41 |
| 3,169,641 | 2/1965 | Chapman | 211/41 X |
| 3,203,557 | 8/1965 | Ettlinger, Jr. | 211/41 X |
| 4,345,688 | 8/1982 | DeBoer | 211/106 X |

*Primary Examiner*—Victor N. Sakran
*Assistant Examiner*—Peter A. Aschenbrenner
*Attorney, Agent, or Firm*—John S. Hale

[57] ABSTRACT

The invention provides an improved tray of the type used in dishwashers. The tray has a floor, side and end walls and fingers upstanding from the floor which are formed integrally from rods forming the floor. The tray has longitudinal rods in two groups, the first group having ends upstanding in the end walls and the second group extending in side walls and having end portions extending in the end walls orthogonally with respect to the upstanding portions of the first group. Apparatus for making the tray and a method of manufacture are also disclosed.

3 Claims, 14 Drawing Figures

DISHWASHER TRAY

This invention relates to trays consisting of a plurality of rods or wires welded to one another, and more particularly to such a tray for use in supporting dishes in a dishwasher.

The invention will be described with reference to a particular tray for use in a dishwasher. However this tray is exemplary of many trays which could be used to support and locate elements such as dishes and the like.

Dishwasher trays are conventionally made up of wires or rods welded orthogonally to one another to form a floor and integral end and side walls. Such trays are made by first forming individual rods, placing them in a suitable fixture, and adding at least one loop or continuous peripheral rod which must be located about ends of upright rods in the walls. The structure is then welded at intersections of the rods. The method is time consuming and labour intensive.

Most dishwasher trays also include upstanding fingers which are welded to the main rods in the floor and which are used to support upturned cups, glasses, etc. These fingers must be attached individually and as a result the strength of connection varies greatly. Further, because the ends are exposed, there is a tendency for protective coatings of synthetic plastic material to wear away at ends of the fingers resulting in discolouration and eventually rusting.

It is an object of the present invention to provide an improved tray suitable for use in dishwashers, to also provide an improved method of making such trays, and to further provide apparatus for making the trays.

This and other objects of the invention will be better understood from the following description and drawings in which.

Figure 1:
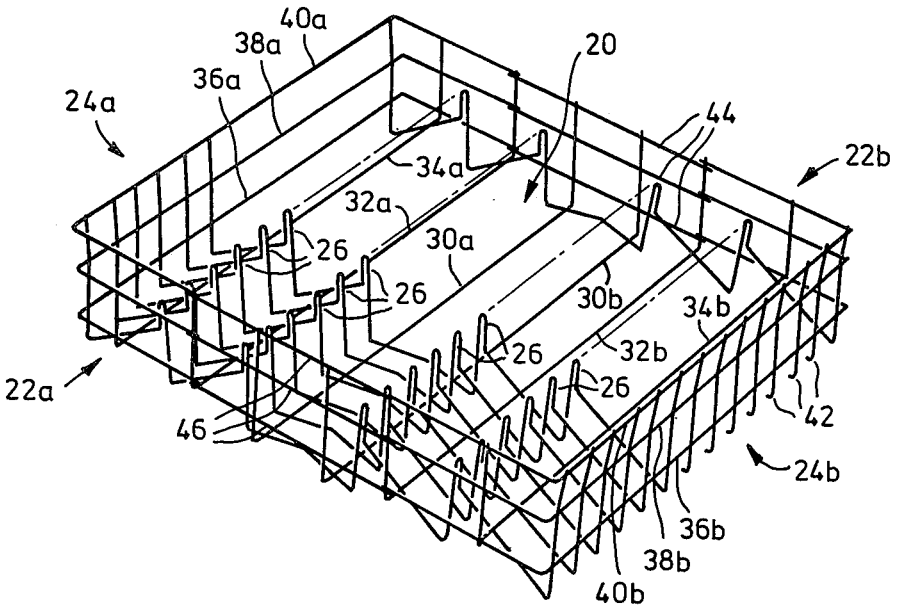
FIG. 1 is a simplified perspective view of a preferred embodiment of the invention as applied to a dishwasher tray.

A tray will described as an exemplary embodiment of the preferred form of the invention. This embodiment is shown in FIG. 1 where it will be seen that the tray consists generally of a floor 20, end walls 22*a*, 22*b* and side walls 24*a*, 24*b*. The floor 20 is made of angled sections for supporting dishes in various positions for enhanced water drainage and a series of fingers 26 are upstanding from the floor. The complete tray or basket is made up of wires or rods welded to one another orthogonally. To simplify description, the rods extending between the ends 22*a*, 22*b* will be described as "longitudinal" whereas those extending between the sides 24*a*, 24*b* will be described as being "transverse".

The formation of the tray will be described generally with reference initially to FIGS. 1 to 4 and then subsequently in more detail with reference to apparatus shown in FIGS. 6, 7 and 14. Further, the method will be highlighted with reference to the sequential FIGS. 7 to 13.

Figure 2:
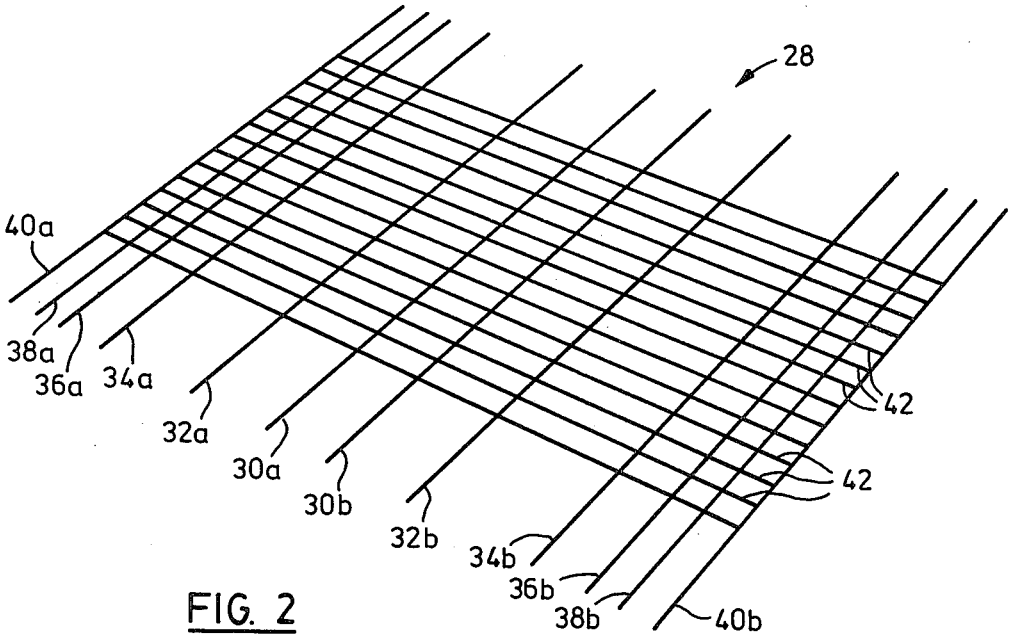
FIG. 2 is a perspective view of a mat used to make the dishwasher tray.

Reference is now made to FIG. 2 which illustrates a mat designated generally by the numeral 28 and used as a basis for making the tray. The mat is created by welding orthogonally a plurality of longitudinal rods to a plurality of transverse rods. The longitudinal rods consists of a pair of central rods 30*a* and 30*b*, intermediate rods 32*a*, 32*b*, outer rods 34*a*, 34*b*, lower wall rods 36*a*, 36*b*, intermediate wall rods 38*a*, 38*b* and upper wall rods 40*a*, 40*b*. It will be evident from this drawing that the rods designated with the suffix "a" are positioned symmetrically around a central line with reference to the similarly numbered rods designated with the suffix "b". By contrast, transverse rods 42 are equally spaced and terminate at the upper wall rods 40*a*, 40*b*.

For the purposes of description it is convenient to break the mat 28 into portions which become parts of walls. The portions of the rods which become part of the floor 20 (FIG. 1) are designated as "central portions". These are effectively those parts of the longitudinal rods which cross the transverse rods, and in the case of the transverse rods, the term refers to the portions extending between the longitudinal outer rods 34*a* and 34*b*. Those parts of the longitudinal rods extending beyond the transverse rods will be referred to as "end portions" and those portions of the transverse rods which extend outwardly beyond the longitudinal rods 34*a*, 34*b* will have a similar designation. Also, as indicated by the terminology used, the longitudinal rods fall into two distinct groups. The rods 30*a*, 30*b*, 32*a*, 32*b*, 34*a*, and 34*b* form a first group whereas the other rods form a second group. The distinction between the groups is that those of the first group have end portions which eventually will become vertical in the end walls whereas the end portions in the second group will become horizontal in the end walls. This will be evident from a careful review of FIG. 1 but will be described in more detail subsequently.

Figure 3:
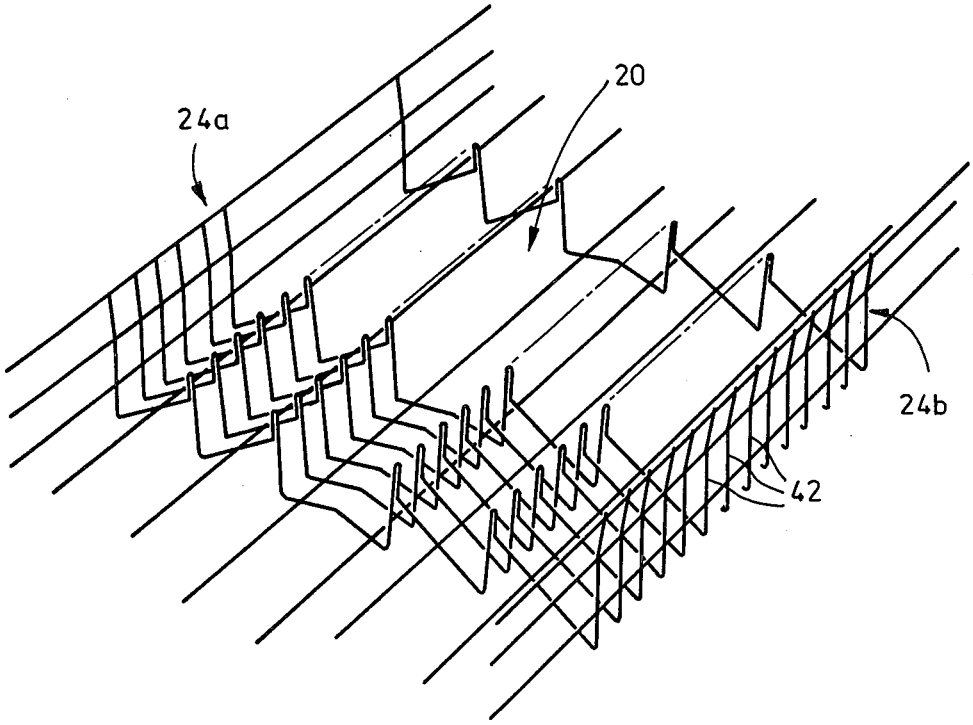
FIGS. 3 and 4 are also perspective views showing stages in the construction of the tray from the mat.
Figure 4:
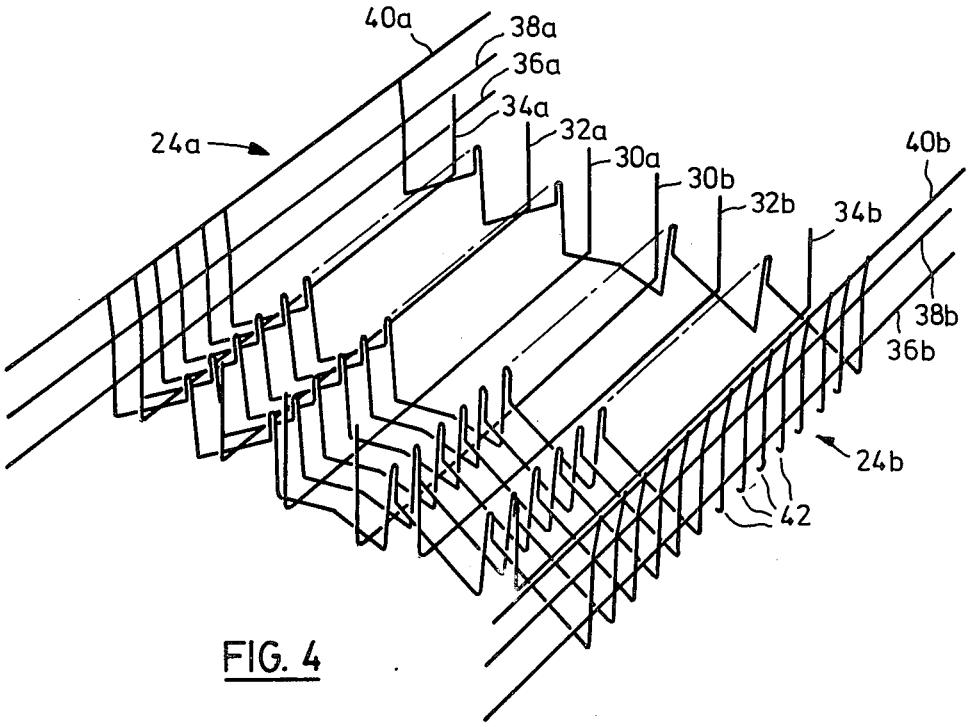

The arrangement of the walls will be better understood with reference to FIGS. 3 and 4. As seen in FIG. 3, the floor 20 has been formed and the end portions of the transverse rods 42 have been turned upwardly into the general plane of the side walls 24*a*, 24b. This completes the forming of the transverse rods and the remainder of the forming to define the end walls 22*a*, 22*b* (FIG. 1) takes place independently of the transverse rods 42.

After reaching the position shown in FIG. 3, the end portions of the first group of longitudinal rods are deflected upwardly into the position shown in FIG. 4. Next, end portions of the second group of longitudinal rods which now lie in the planes of the respective side walls are deflected horizontally into the plane of the end walls and in contact with respective end portions of the longitudinal rods 32*a*, 32*b*, 34*a*, and 34*b*. This position is best seen in FIG. 1 which shows the end portions of the longitudinal rods extending horizontally from the side walls and terminating at the respective upturned longitudinal rods 32*a*, 32*b*. The structure is completed by attaching two groups of three auxiliary rods 44, 46 which are attached to the upturned end portions of the longitudinal rods 32*a*, 32*b* and to the upturned end portions of the longitudinal rods 30*a*, 30*b*. These auxiliary rods consolidate the structure and maintain the walls in fixed rigid relationship with one another.

Figure 5:
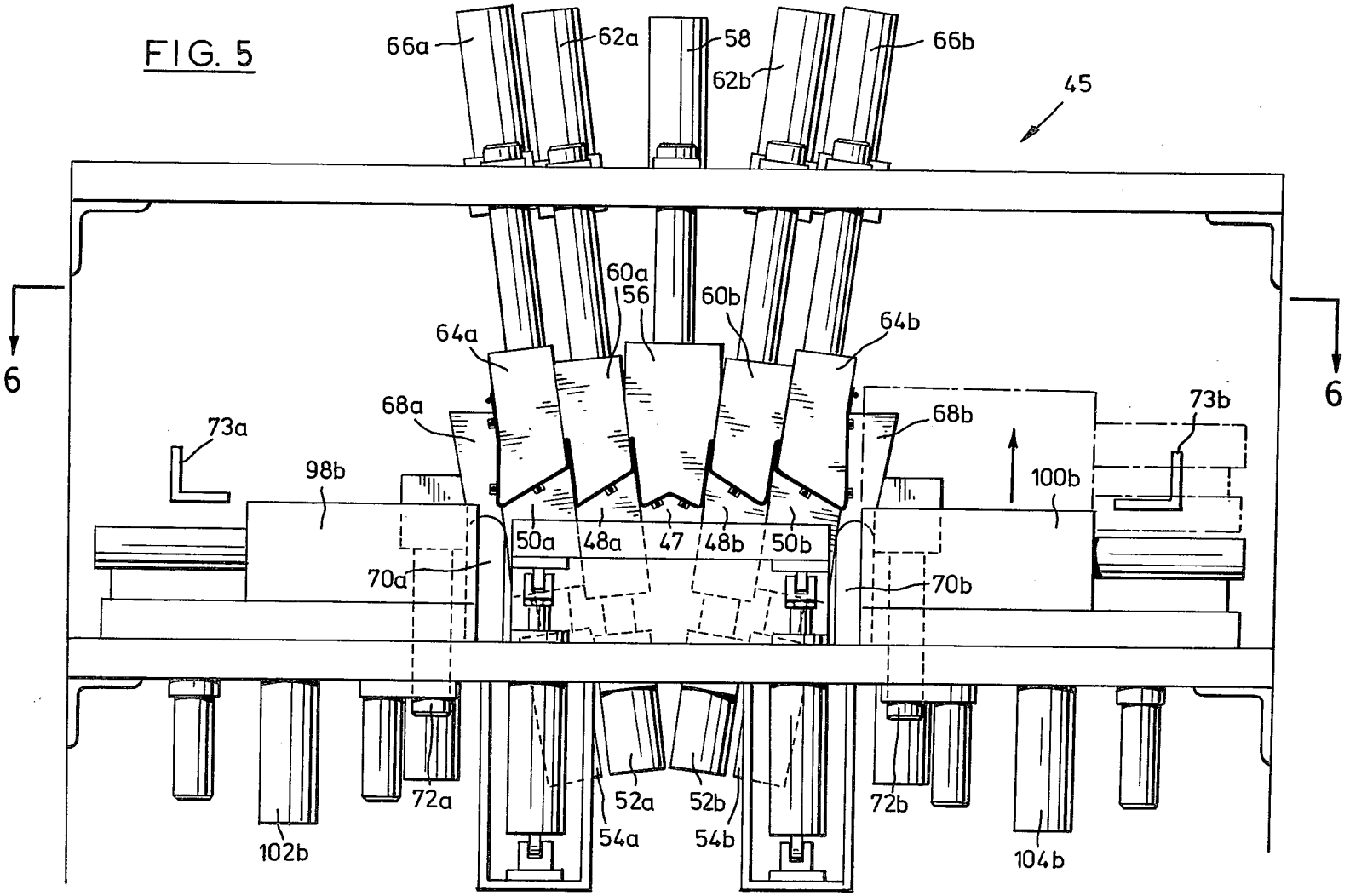
FIG. 5 is a simplified side view of a preferred embodiment of apparatus used to make the tray from the mat and shown after partially forming the tray.
Figure 6:
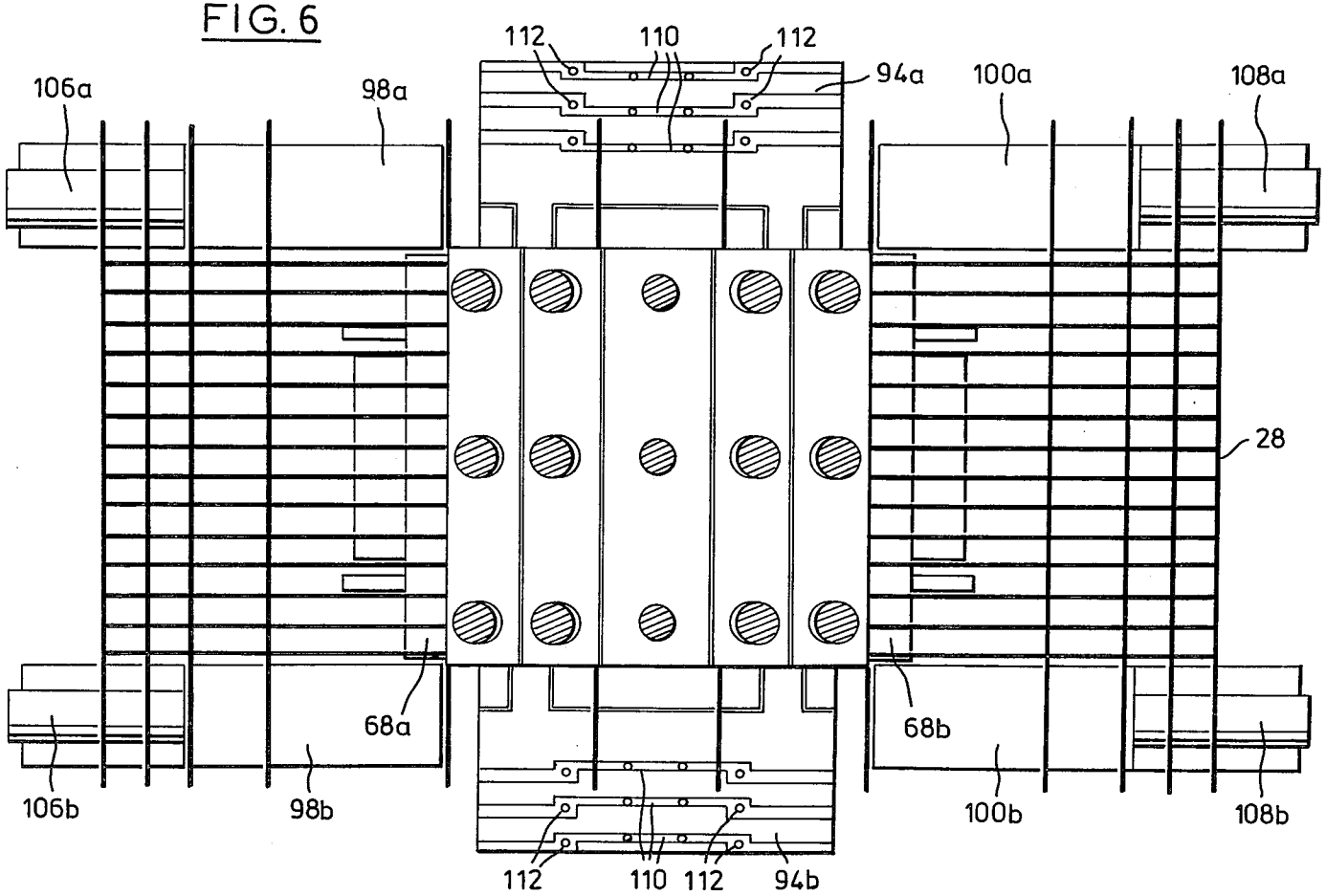
FIG. 6 is a sectional plan view of the apparatus on line 6—6 of FIG. 5 and showing a mat in place prior to forming.

Reference will next be made to FIGS. 5 and 6 to describe the apparatus as it is used to form the floor 20 (FIG. 1) of the tray. The description of FIGS. 5 and 6 will be associated with description of the method as illustrated in FIGS. 7 to 13.

As seen in FIG. 5, a support frame 45 carries a fixed central lower die 47, a pair of lower intermediate dies 48*a*, 48*b* which border the fixed die 47 and a pair of end dies 50*a*, 50*b* adjacent the intermediate dies. The dies 48*a*, 48*b* can be moved generally vertically by respective actuators 52*a*, 52*b* and similarly, the dies 50*a*, 50*b* can be moved by actuators 54*a*, 54*b*. It will be noted that the dies are arranged to move with a slight offset from the vertical. The angle of this offset is dictated by the desired positions and shapes of the intermediate walls in forming parts of the bottom of the tray. Similarly, upper dies are arranged to move along corresponding lines. An upper central die 56 can be driven vertically by an actuator 58 whereas upper intermediate dies 60*a*, 60*b* can be moved in alignment with corresponding lower dies by actuators 62*a*, 62*b*. Similarly, upper end dies 64*a*, 64*b* are driven by actuators 66*a*, 66*b* in alignment with corresponding lower actuators 54*a*, 54*b*. The dies described thus far are used to shape the bottom of the tray. However, in order to complete the shape defined by FIG. 3, the end portions of the transverse rods 42 (FIG. 3) must be moved upwardly carrying with them the second group of longitudinal rods. This is achieved by two side plates 68*a*, 68*b* which are pivoted on supports 70*a*, 70*b* and driven by respective actuators 72*a*, 72*b*. The effect of operating the actuators is to pivot the side plates 68*a*, 68*b* into the position shown which carries the end portions of the transverse rods upwardly to form the side wall. Sides of the outer or end dies 64*a*, 64*b* are used in combination with the plates 68*a*, 68*b* to locate the end portions of the rods. It will be appreciated that the dies and side plates are recessed when necessary to accommodate longitudinal rods since the forming operation is bending the transverse rods and not the longitudinal rods.

The arrangement of the side plates 68*a*, 68*b* can be seen in FIG. 6 which also illustrates the arrangement of the mat 28 prior to forming in the apparatus. Initially the mat is supported on elements 73*a*, 73*b* shown in FIG. 5 which also locates the mat relative to the dies. The forming operation commences when the central upper die 56 is brought downwardly into contact with the mat as shown in FIG. 7.

Figure 7:
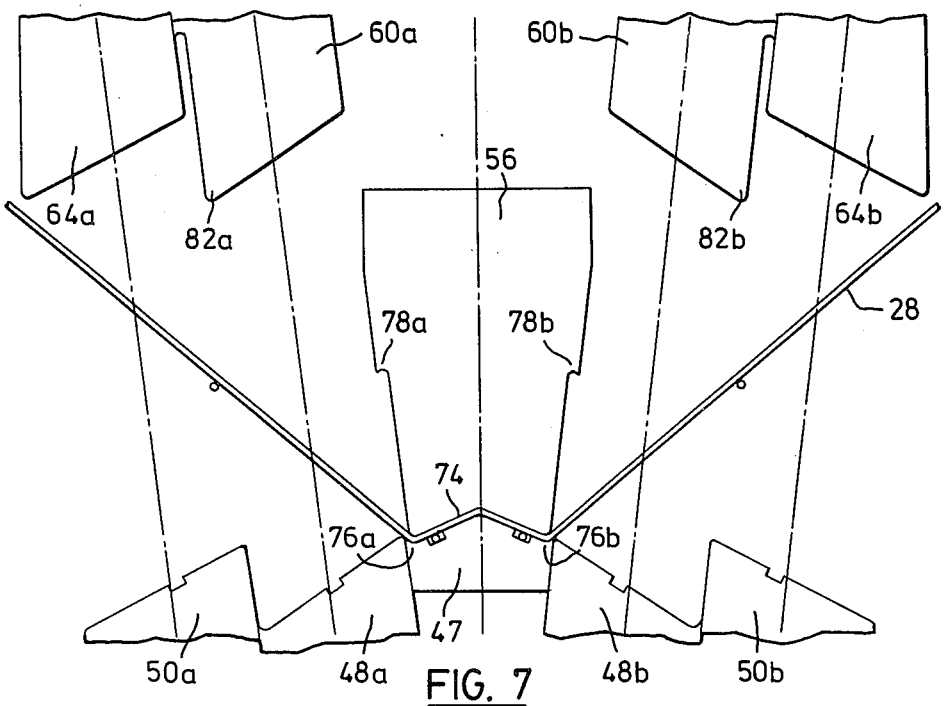
FIGS. 7 to 13 are diagrammatic side views of the apparatus and illustrating the steps of a preferred method of forming the floor and upstanding fingers of the tray.
Figure 8:
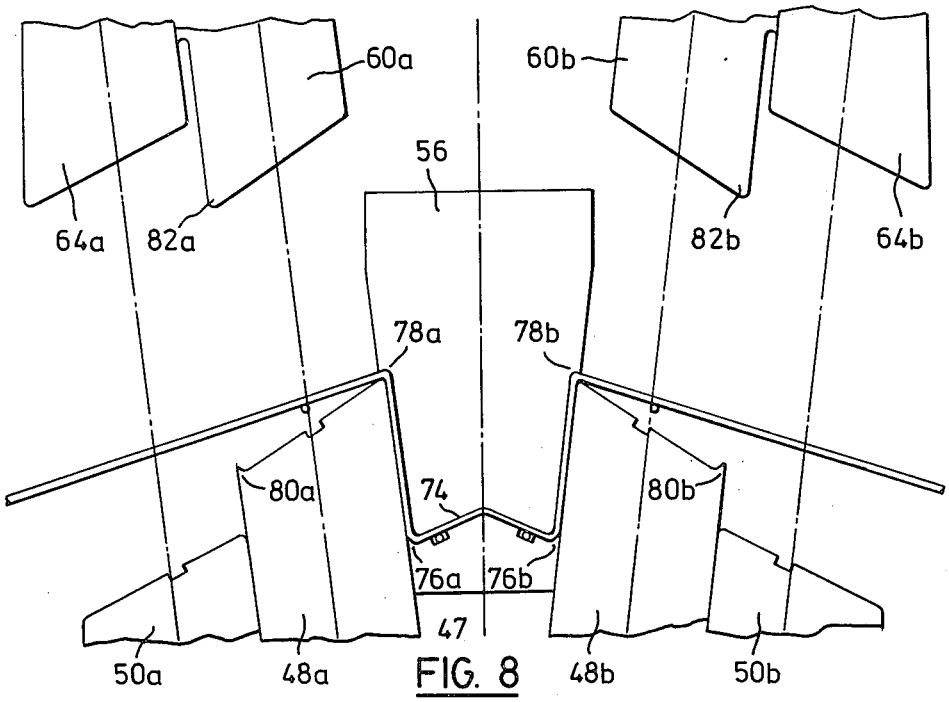

Reference is next made to FIG. 7 to describe the initial step of forming a central portion 74 of the floor of the tray. As will be seen in FIG. 7 the fixed die 47 supports the mat 28 while the upper central die 56 moves downwardly into engagement with the mat to deflect the transverse wires into the shape shown. The top of the die 47 is ridged into the shape generally of an inverted "V" and includes upwardly-extending peripherial lips 76*a*, 76*b*. These lips combine with rounded edges on the die 56 to deflect the mat 28 upwardly in preparation for the next forming step. This upward angulation in effect gives a lead for the intermediate dies 48*a*, 48*b* which, as better seen in FIG. 8 are made to move upwardly. This upward movement has the effect of wrapping the mat 28 about the die 56 into the position shown in FIG. 8. As better seen in FIG. 7 the die 56 defines rounded shoulders 78*a*, 78*b* against which the mat 28 is driven by the dies 48*a*, 48*b* causing an outward and downward deflection of the mat in preparation for the step following that shown in FIG. 8. Before proceeding to FIG. 9 it should be noted that the dies 48*a*, 48*b* define lips 80*a*, 80*b* similar to the lips 76*a*, 76*b* of the die 47. These lips combine with respect to rounded edges 82*a*, 82*b* of upper dies 60*a*, 60*b* in a subsequent step as will be described.

Figure 9:
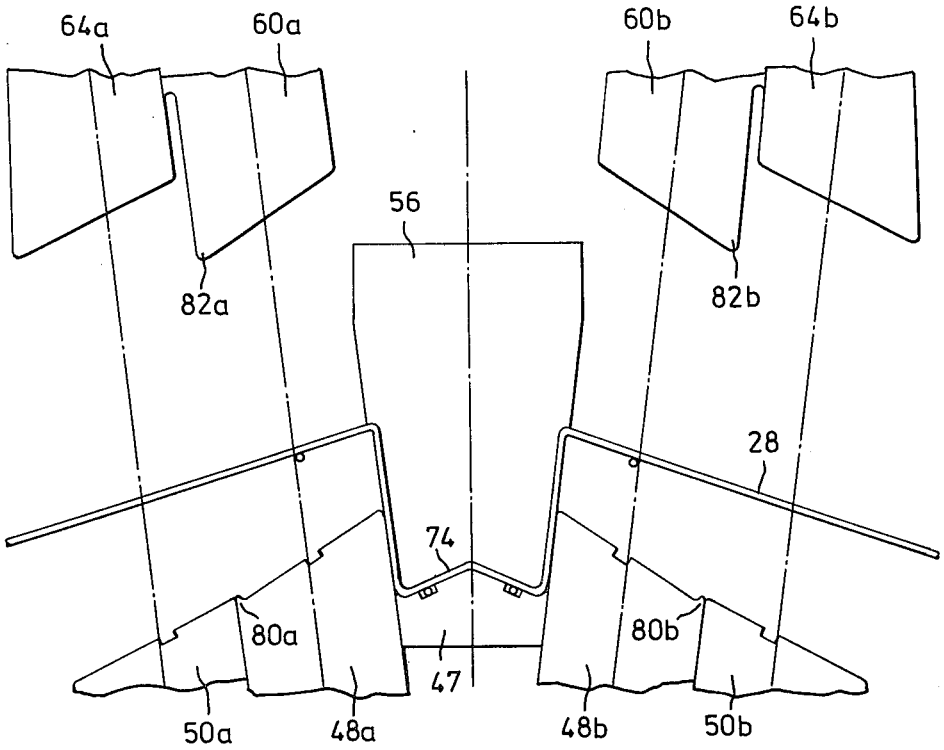
Figure 10:
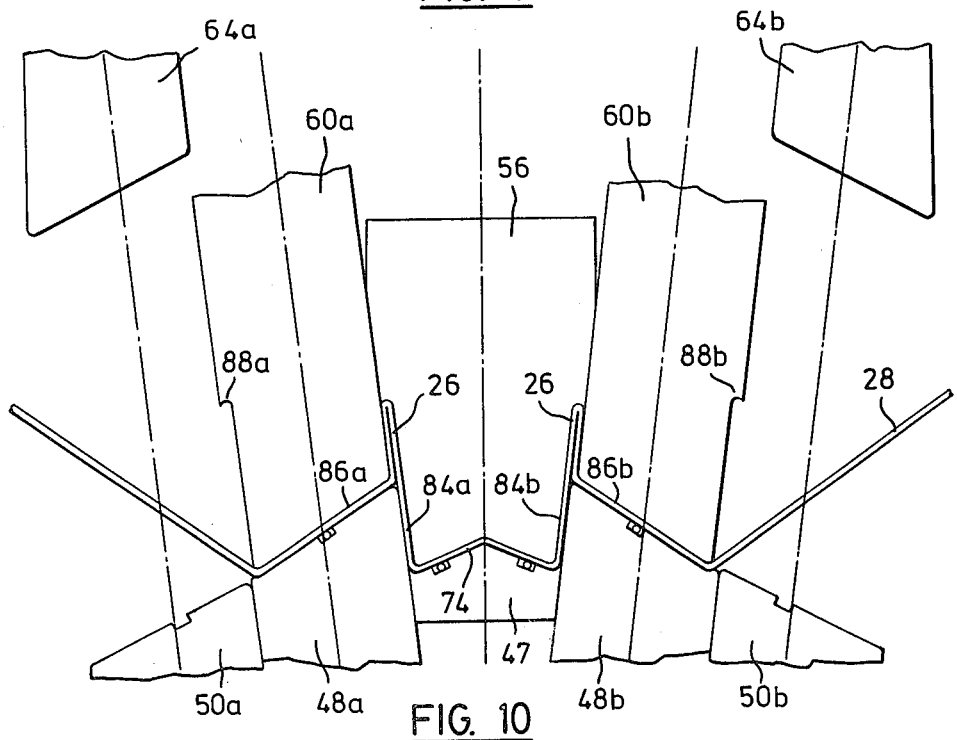

After completing the step illustrated in FIG. 8, the dies 48*a*, 48*b* are withdrawn to a point shown in FIG. 9. The upper intermediate dies 60*a*, 60*b* are then moved downwardly to slide down the sides of the die 56 into engagement with the mat which has portions projecting outwardly and downwardly from the die 56. Those portions of the mat in contact with the die 56 lie in a plane parallel to the line of action of the respective adjacent upper dies 60*a*, 60*b* so that these portions of the mat are resistent to deflection by these dies. Consequently when the dies come into contact with the outward portions of the mat the mat is initially deflected downwardly ending about portions adjacent the respective shoulders 78*a*, 78*b* of the die 56. Then the portions are swept downwardly by the dies into a position shown in FIG. 10 where the final movement of the dies causes the rounded edges 82*a*, 82*b* to combine with the lips 80*a*, 80*b* of the dies 48*a*, 48*b* to again deflect outward portions of the mat upwardly as shown in FIG. 10. The result is to form fingers 26 above respective intermediate walls 84*a*, 84*b* forming parts of the floor of the tray. Also, intermediate and angled portions 86*a*, 86*b* of the floor are created below dies 60*a*, 60*b*.

Figure 11:
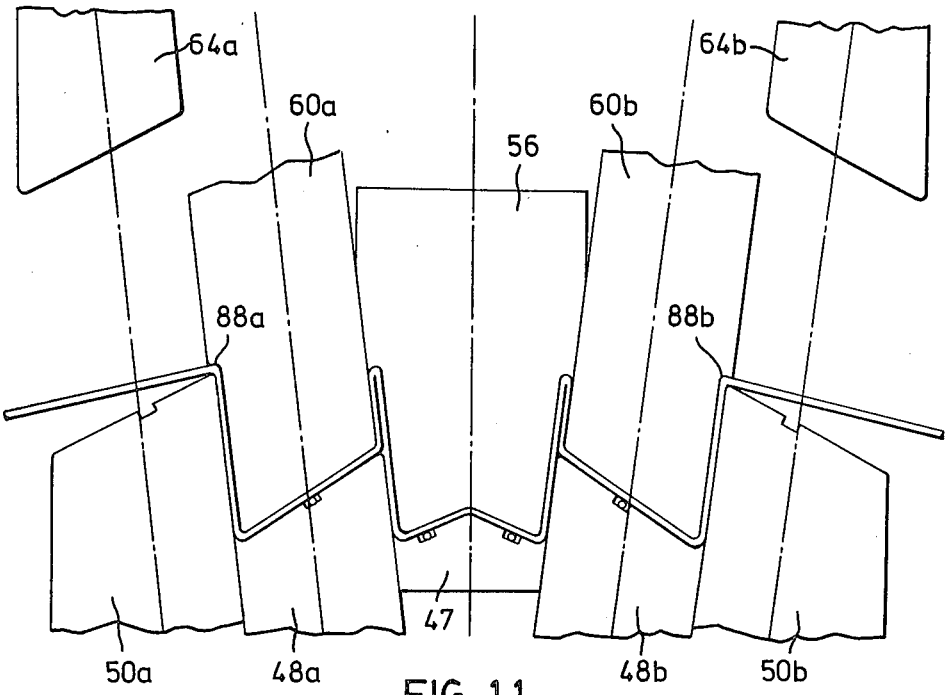

The process described with reference to FIGS. 9 and 10 is effectively repeated to create further rows of fingers and intermediate walls. As seen in FIG. 11, the dies 50*a*, 50*b* are moved upwardly to sweep the mat around the dies 60*a*, 60*b* and into engagement with shoulders 88*a*, 88*b* leaving a portion of the mat deflected downwardly and outwardly. (For the sake of clarity, the entire mat is not shown which will be evident by comparison with FIG. 3).

Figure 12:
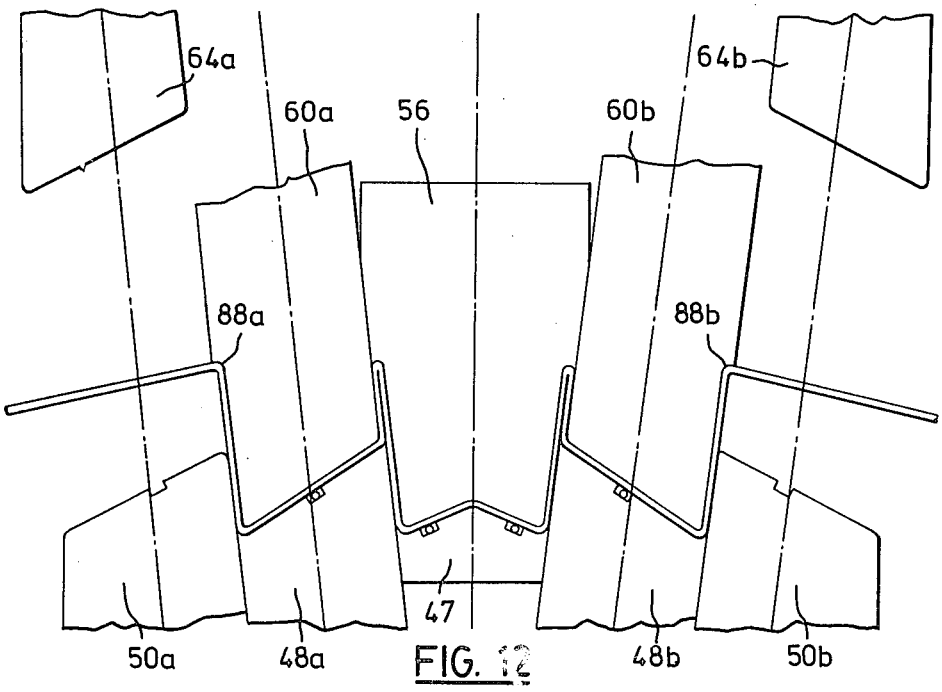
Figure 13:
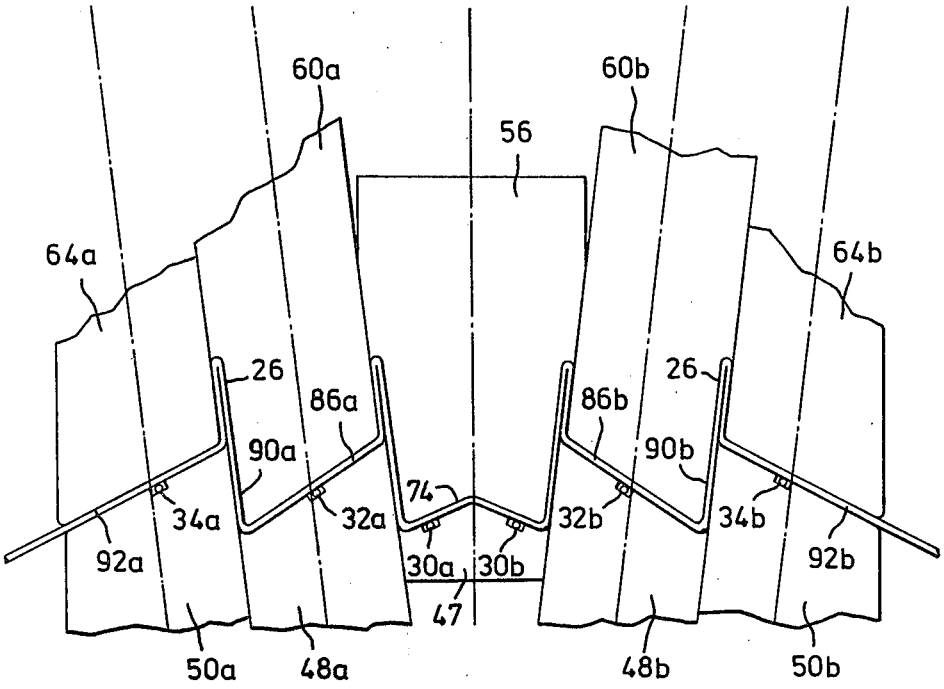

After completing the steps shown in FIG. 11, the lower dies 50*a*, 50*b* are withdrawn partially to the position shown in FIG. 12 before the upper dies 64*a*, 64*b* are brought into position to deflect the mat into the FIG. 13 position thereby defining further fingers 26 above respective intermediate walls 90*a*, 90*b*. Also, further portions of the floor 92*a*, 92*b* are created leaving the mat in the condition shown in FIG. 3 with the exception that end portions of the transverse rods 42 continue outwardly in the plane of the floor portions 92*a*, 92*b* and have not yet been swept upwardly into the FIG. 3 position.

It will be appreciated that the dies have been shown diagrammatically in FIGS. 9 to 13. The actual radii used will depend upon the diameter of the rods used in the mat and on the angle of deflection required. Also, recesses for the longitudinal rods have been shown and this will be evident from FIG. 13 where these rods are identified using numerals found in FIG. 2.

As previously described with reference to FIG. 5, after the floor has been formed to the shape shown in FIG. 13, the end portions of the transverse rods are swept upwardly to form the side walls by the operation of side plates 68*a*, 68*b* driven by actuators 72*a*, 72*b*. After this operation the transverse rods have been fully formed so that the floor is shaped, the side walls are complete, and the mat is in the shape shown in FIG. 3. It is then necessary to follow the steps of sweeping up the end portions of the longitudinal rods of the first group into the position shown in FIG. 4 and then wrapping the end portions of the second group of longitudinal rods into the end walls to complete the structure shown in FIG. 1.

The first group of longitudinal rods are swept upwardly by hinged end plates 94*a*, 94*b* shown in FIG. 6. These plates operate to deflect the first group of longitudinal rods in the same manner as the side plates 68*a*, 68*b* when sweeping end portions of the transverse rods. However, the plates 94*a*, 94*b* also serve to locate the auxiliary rods 44 (FIG. 1) as will be described. This location is the last step in the assembly.

Figure 14:
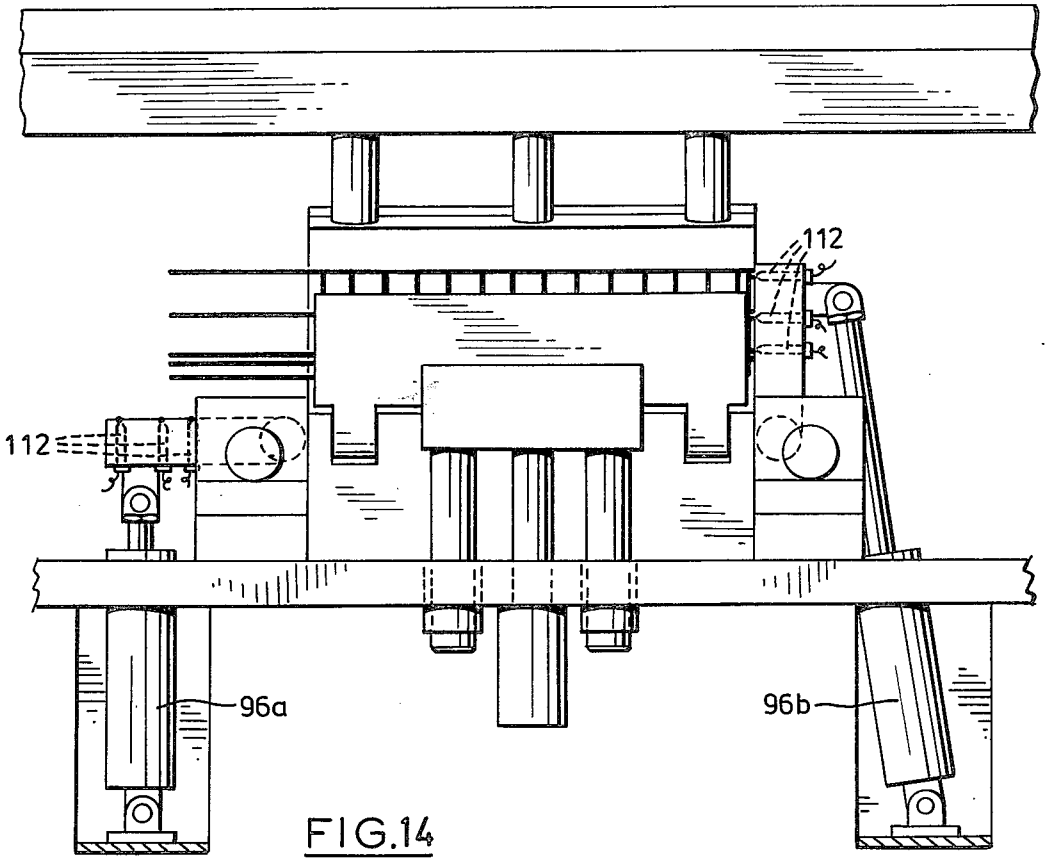
FIG. 14 is an end view of the apparatus and further illustrating the method.

After the end plates 94*a*, 94*b* have been brought into position by respective actuators 96*a*, 96*b* shown in FIG. 14, the plates are returned to their original positions leaving the mat in the shape shown in FIG. 4. Next, corner elements or dies 98*a*, 98*b* and 100*a*, 100*b* (FIG. 6) are elevated by actuators associated with them such as the actuators 102*b* and 104*b* shown in FIG. 5. This elevation brings the elements into position to deflect end portions of the second group of longitudinal rods some of which are shown in FIG. 14 prior to deflection. The elements 98*a*, 98*b* and 100*a*, 100*b* are moved horizontally by associated actuators 106*a*, 106*b* and 108*a*, 108*b*. This sweeping action makes use of the top dies 64*a*, 64*b* by wrapping the end portions of the rods around these dies. It will be appreciated that the elements 98*a*, 98*b* and 100*a*, 100*b* will be shaped to control the movement of the rods and are preferably grooved to retain the rods as they are deflected. Also, associated with these elements are a series of welding heads which are not shown in the drawing and which will be similar to those to be described with reference to plates 94*a*, 94*b*. These welding heads are used to cause welds between end portions of the second group of longitudinal rods which have been swept into position by the elements 98*a*, 98*b* and 100*a*, 100*b*, and the upturned end portions of the longitudinal rods of the first group 32*a*, 32*b* and 34*a*, 34*b* (FIGS. 1 and 2). The elements 98*a*, 98*b* and 100*a*, 100*b* can now be withdrawn and lowered, the side plates 68*a*, 68*b* (FIG. 5) are lowered and the outer top dies 64*a*, 64*b* are moved upwardly. It will be evident from FIG. 5 that the shape of these dies is such that the tray will be deflected as the dies are withdrawn and this is made possible by a combination of the resiliency of the material and the fact that the auxiliary rods 44 (FIG. 1) are not yet in place so that the side walls 24*a*, 24*b* are not connected directly to one another above the level of the floor.

Next the end plates 94*a*, 94*b* are moved upwardly again carrying with them auxiliary rods 44 located in grooves 110 which both locate and support the rods during this operation. The grooves are proportioned so that the rods are slightly proud of the plate for engagement with end portions of the longitudinal rods 30*a*, 30*b* and 32*a*, 32*b* (FIG. 1). Also, the plates include recesses to provide clearance to provide end portions of the second group of rods which now lie horizontally in the end walls.

The end plates 94*a*, 94*b* are associated with spot welding heads 112 which are also seen in FIG. 14. After the plates are brought into position the welding heads can be energized to cause welding between the auxiliary rods 44 and the associated end portions of the central longitudinal rods 30*a*, 30*b* and the intermediate longitudinal rods 32*a*, 32*b* (FIG. 1). The tray is now complete and the plates 94*a*, 94*b* can be pivoted downwardly, the other dies withdrawn progressively, and the tray lifted from the apparatus.

It will be evident from the FIG. 1 description that the shape of the tray can be varied. As mentioned earlier, the tray is exemplary of many trays which can be made using the present method and apparatus. Variations to the tray are within the scope of the invention. For instance, a tray which is shaped to extend about a spray head in a dishwasher can be formed using the same general procedure in one of two ways. Firstly the apparatus described can be used with a mat which is shaped to create only the main part of the tray. Subsequently the additional parts can be added. Alternatively the dies can be shaped to make the new tray completely from a suitably shaped mat.

Further variations can be made to the shape of the floor of the tray and also to the end walls. In some circumstances the auxiliary rods 44 can be omitted provided that the trapped end dies 64*a* and 64*b* are first removed.

It will also be evident that the upper ends of rods 30*a*, 30*b*, 32*a*, 32*b*, 34*a* and 34*b* will have to be trimmed. In fact it is preferable to arrange the mat such that the side rods 36*a*, 36*b*, 38*a*, 38*b*, 40*a* and 40*b* are proportioned such that cropping the ends of these rods and the other longitudinal rods in one operation will result in the aforementioned upper ends projecting upwardly sufficient for cropping. This ensures that the variations in sizes inevitable in such a structure will not cause the rods such as rod 30*a* to fall short of the top of the end walls. Such a dimensioning dictates the length of the auxiliary rods 44. A wider tray (a side-to-side measurement) will result in longer rods 44 whereas a narrower tray could be made with no auxiliary rods.

I claim:

1. An open-topped and generally rectangular tray of the type used to support dishes in a dishwasher, the tray comprising:

a floor made up of central portions of a first group of longitudinal rods of a first length and by central portions of transverse rods having a second length and attached to the central portions of the longitudinal rods orthogonally and shaped to support said dishes in a selected arrangement;

a pair of side walls made up of upstanding end portions of the transverse rods and by central portions of a second group of longitudinal rods also of said first length and attached to the upstanding end portions othogonally; and a pair of end walls made at least in part of upstanding end portions of the first group of longitudinal rods and by end portions of the second group of longitudinal rods attached othogonally to those of the upstanding end portions of the first group adjacent the side walls, the second group of longitudinal rods extending continuously between said central and end portions of the second group to rigidify the side and end walls.

2. A tray as claimed in claim 1 and further comprising auxiliary rods attached to the remainder of said upstanding end portions of the first group and coupled to the end portions of the second group of longitudinal rods to further rigidify the tray by preventing outward displacement of the side end walls relative to the floor.

3. A tray as claimed in claim 1 and further including fingers upstanding from the floor, each of the fingers being made up of two parts of a transverse rod extending downwardly from a U-shaped bend at the upper extremity of the finger.

* * * * *